US008541763B2

(12) United States Patent
Roy

(10) Patent No.: US 8,541,763 B2
(45) Date of Patent: Sep. 24, 2013

(54) MODIFIABLE LAYERED SHIELD ASSEMBLY

(75) Inventor: Michael P. Roy, Kingston, TN (US)

(73) Assignee: Siemens Medical Solutions USA, Inc., Malvern, PA (US)

( * ) Notice: Subject to any disclaimer, the term of this patent is extended or adjusted under 35 U.S.C. 154(b) by 0 days.

(21) Appl. No.: 13/437,187

(22) Filed: Apr. 2, 2012

(65) Prior Publication Data

US 2013/0020512 A1 Jan. 24, 2013

Related U.S. Application Data

(60) Provisional application No. 61/509,602, filed on Jul. 20, 2011.

(51) Int. Cl.
*G21F 5/00* (2006.01)

(52) U.S. Cl.
USPC ..... 250/505.1; 250/506.1; 250/507.1; 250/515.1

(58) Field of Classification Search
None
See application file for complete search history.

(56) References Cited

U.S. PATENT DOCUMENTS

| | | | | |
|---|---|---|---|---|
| 8,374,306 | B2 * | 2/2013 | Norling et al. | 376/190 |
| 2003/0204126 | A1 * | 10/2003 | Rivard | 600/3 |
| 2006/0017411 | A1 * | 1/2006 | Hamm | 315/505 |
| 2006/0284122 | A1 * | 12/2006 | Caldwell | 250/515.1 |
| 2008/0067413 | A1 * | 3/2008 | Nutt | 250/432 PD |
| 2010/0329406 | A1 * | 12/2010 | Norling et al. | 376/112 |

* cited by examiner

*Primary Examiner* — Andrew Smyth
(74) *Attorney, Agent, or Firm* — Peter Kendall

(57) ABSTRACT

A shield for absorbing radiation emitted by a target during operation of a cyclotron. The shield includes an inner box structure having a recess for receiving the target. In addition, the shield includes a first plurality of shield elements arranged in a layered configuration about the inner box structure. The shield also includes an outer box structure for receiving the inner box structure and the first plurality of shield elements. Further, a second plurality of shield elements is arranged in a layered configuration about the outer box structure. The shield elements are arranged in both horizontal and vertical orientations and are removable.

21 Claims, 5 Drawing Sheets

MODIFIABLE LAYERED SHIELD ASSEMBLY

CROSS REFERENCE TO RELATED APPLICATIONS

This application claims the benefit under 35 U.S.C. §119 (e) of U.S. Provisional Application No. 61/509,602 entitled MODIFIABLE LAYERED SHIELD ASSEMBLY, filed on Jul. 20, 2011 which is incorporated herein by reference in its entirety and to which this application claims the benefit of priority.

FIELD OF THE INVENTION

This invention relates to shields used with cyclotrons for shielding against radiation, and more particularly, to a shield assembly located within a movable shield wherein the shield assembly includes removable layered shield elements.

BACKGROUND OF THE INVENTION

Positron Emission Tomography (PET) is a procedure used for imaging and measuring physiologic processes within the human body. As part of the procedure, radioisotopes are injected into a patient to assist in diagnosing and assessing a disease. A cyclotron or particle accelerator is used to produce the radioisotopes. In a cyclotron, a particle beam is accelerated which then bombards a target material housed in a target system of the cyclotron. Referring to FIG. 1*a*, a general configuration for shielding a cyclotron 10 is shown. The cyclotron 10 is positioned between movable shields 12 and 14 (shown in an open position thus exposing the cyclotron 10) and stationary shields 16 and 18. Referring to FIG. 1*b*, the cyclotron 10 generates a particle beam 20 that then bombards target material 22 located within target enclosure 24 to produce a radioactive isotope which then decays. The decay of the isotope as well as other interactions generates gamma and neutron radiation 26 that is attenuated by the shields 12,14, 16,18 so as to protect personnel in the vicinity of the cyclotron against unsafe levels of radiation.

Typically, cyclotron shields are configured as large, monolithic blocks of shielding material that includes lead shot suspended in a polymer matrix, for example. However, this approach has disadvantages from the viewpoint of design, manufacturing, disposal and the environment. In particular, it is preferable that the material used for the shields is specifically adapted for shielding against the radiation that is being emitted, such as gamma and neutron radiation, so that each form of radiation is addressed separately. Further, an approach to shielding is needed which is easily configured to better suit the needs of specific cyclotron configurations, uses materials which minimizes potential environmental effects and is easier to assemble during manufacturing and disassemble for appropriate disposal when decommissioning a shield.

SUMMARY OF THE INVENTION

A shield for absorbing radiation emitted by a target during operation of a cyclotron is disclosed. The shield includes an inner box structure having a recess for receiving the target. In addition, the shield includes a first plurality of shield elements arranged in a layered configuration about the inner box structure. The shield also includes an outer box structure for receiving the inner box structure and the first plurality of shield elements. Further, a second plurality of shield elements is arranged in a layered configuration about the outer box structure.

DESCRIPTION OF THE INVENTION

Figure 1A:
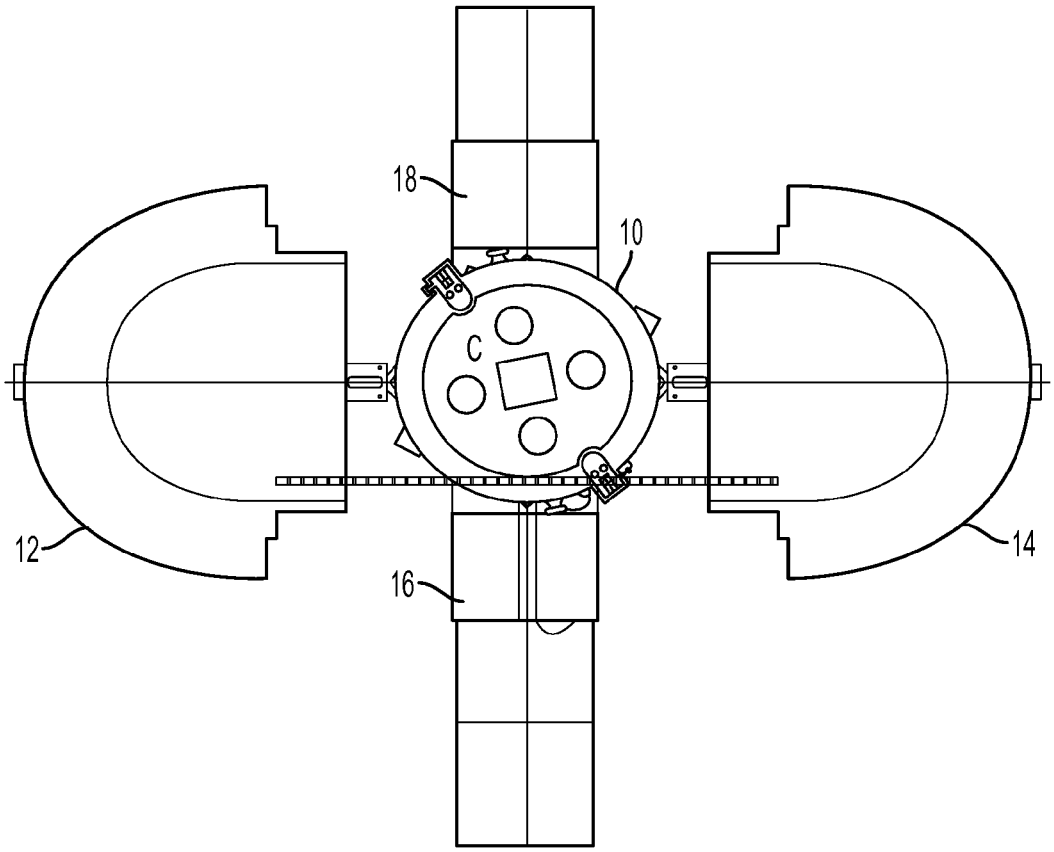
FIG. 1*a* depicts a general configuration for shielding a cyclotron.
Figure 1B:
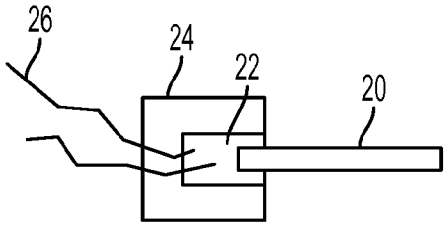
FIG. 1*b* depicts a cyclotron and generation of a radioisotope.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass direct and indirect mountings, connections, supports, and couplings. Further, "connected" and "coupled" are not restricted to physical or mechanical connections or couplings. In the description below, like reference numerals and labels are used to describe the same, similar or corresponding parts in the several views of FIGS. 1-6.

Figure 2:
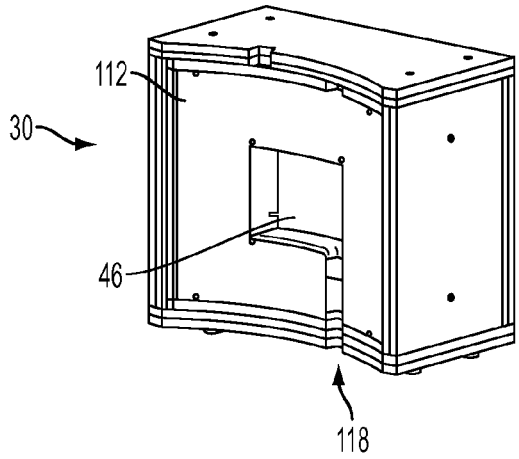
FIG. 2 is an assembled view of a layered shield assembly in accordance with the invention.

Referring to FIG. 2, an assembled view of a modifiable layered shield assembly 30 is shown. As will be described, the layered shield 30 is located in a movable shield 12,14 used in connection with a cyclotron. The layered shield 30 includes inner and outer box structures, a plurality of horizontally and vertically oriented planar shield elements and a cover 112 for providing access to a recess 46. In accordance with the invention, the recess 46 receives a target portion of a cyclotron used for producing radioisotopes for Positron Emission Tomography (PET).

Figure 3A:
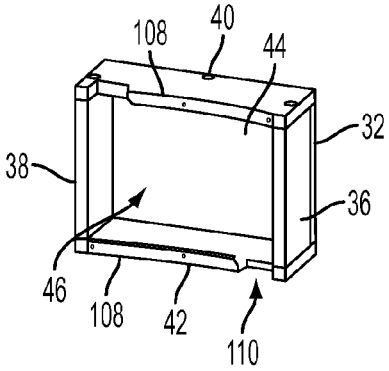
FIGS. 3*a* and 3*b* depict inner and outer box structures for the layered shield.
Figure 3B:
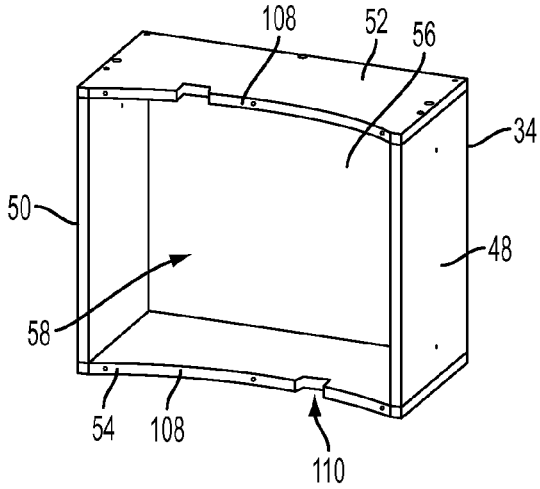

Referring to FIGS. 3*a* and 3*b*, inner 32 and outer 34 box structures, respectively, for the layered shield 30 are shown. The inner 32 and outer box 34 box structures are each fabricated from steel, although other suitable materials may be used. The inner box 32 includes right 36 and left 38 vertical inner surfaces and top 40 and bottom 42 horizontal inner surfaces. The inner box 32 also includes an inner vertical back surface 44 to form the recess 46. The outer box 34 includes right 48 and left 50 vertical outer surfaces and top 52 and bottom 54 horizontal outer surfaces. The outer box 34 also includes an outer vertical back surface 56 to form an opening 58 for receiving the inner box 32.

Figure 4:
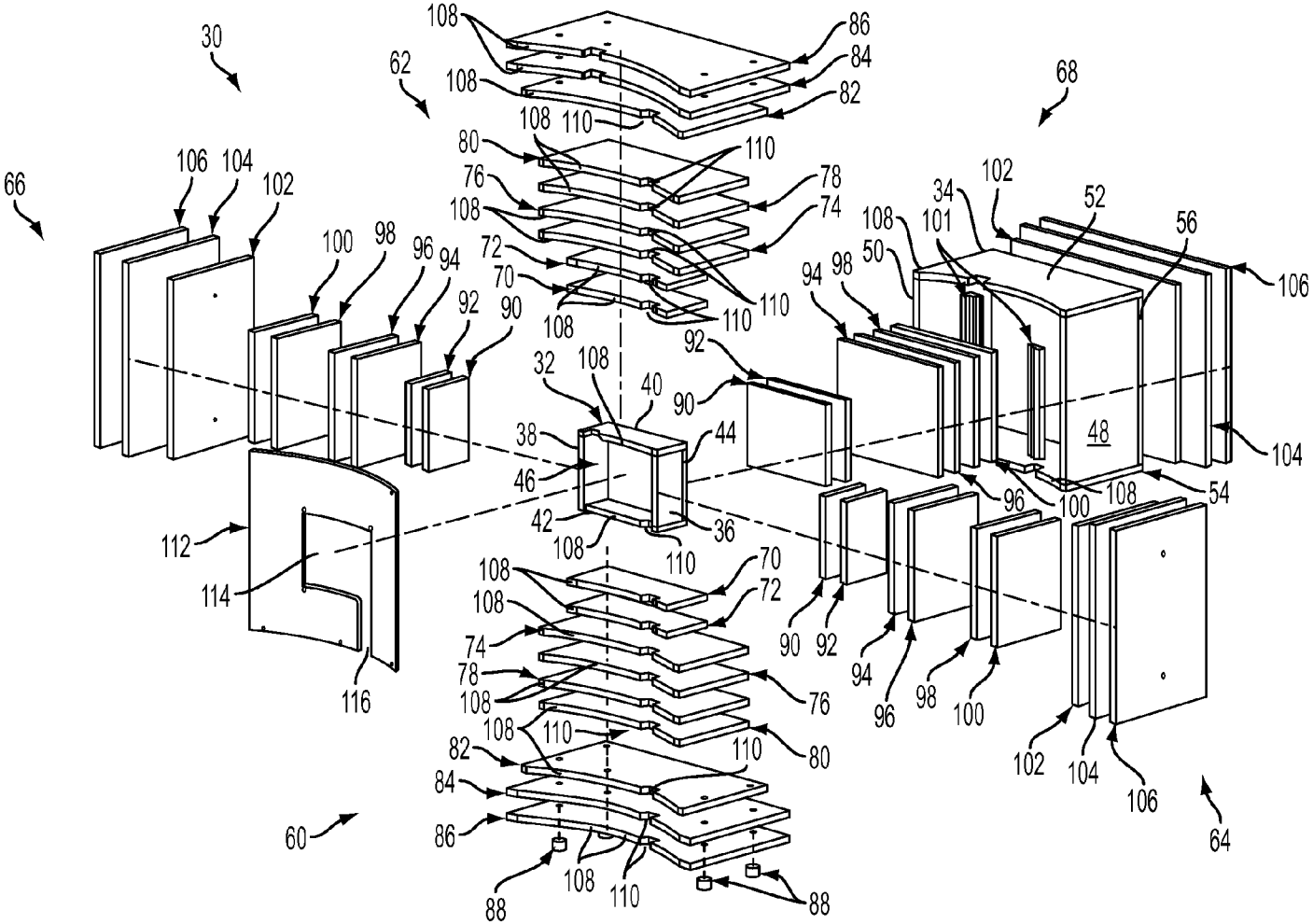
FIG. 4 depicts the layered shield in an exploded view.

Referring to FIG. 4, the layered shield 30 is shown in an exploded view. The layered shield 30 includes a plurality of planar shield elements constructed of steel, borated polyethylene, high density lead and aluminum which serve to shield against gamma and neutron radiation generated during use of the cyclotron. The boron content of the borated polyethylene ranges from 5% to 30%, which is a commercially available range. In other embodiments of the invention, other boron content ranges may be utilized. In accordance with the invention, many smaller shielding layers are used in the invention, in contrast to one or two bulky layers of homogeneous materials as found in conventional, monolithic type radiation shielding. Further, during the shielding process and as radiation is reduced, secondary or lower forms of radiation may be created. The layered shield elements of the invention capture the secondary radiation that may escape a monolithic shield.

The layered shield 30 includes lower 60, upper 62, right 64, left 66 and rear 68 sets of ordered shield elements that are arranged about the inner 32 and outer 34 boxes. Each shield element in each of the lower 60, upper 62, right 64, left 66 and rear 68 sets is fabricated from shielding material or a combination of shielding materials and is configured to shield against radiation generated during operation of a cyclotron. In particular, each shield element incrementally reduces neutron and gamma radiation emitted during operation of a cyclotron.

In one embodiment, the lower set 60 includes first 70, second 72, third 74, fourth 76, fifth 78, sixth 80, seventh 82, eighth 84 and ninth 86 horizontal shield elements. The inner box 32 is positioned within the opening 58 of the outer box 34 when the layered shield 30 is assembled. The first shield element 70 is oriented horizontally underneath and closest to the bottom inner surface 42 (see FIG. 3*a*) of the inner box 32 followed by the remaining shield elements 72,74,76,78,80,82,84,86 which are each oriented horizontally to form a horizontally stacked, layered configuration underneath the bottom inner surface 42. The first 70 and second 72 shield elements each include polyethylene material having 30% boron content (i.e. 30% borated polyethylene). The third 74, fourth 76 and fifth 78 shield elements include lead, 5% borated polyethylene and lead material, respectively, arranged in an alternating configuration. The sixth 80 and seventh 82 shield elements each include 5% borated polyethylene material. The eighth 84 and ninth 86 shield elements include standard polyethylene material. The first through sixth shield elements 70,72,74,76,78,80 are located within the opening 58 (see FIG. 3*b*) of the outer box 34 when the layered shield 30 is assembled. The bottom outer surface 54 of the outer box 34 is positioned between the sixth 80 and seventh 82 shield elements when the layered shield 30 is assembled and serves as an additional shield element. The seventh 82, eighth 84 and ninth 86 elements are fastened to the bottom outer surface 54. Feet members 88 are attached to the ninth shield element 86 which serve to support the layered shield 30.

The upper set 62 includes a second set of the first through ninth shield elements 70,72,74,76,78,80,82,84,86. The first shield element 70 of the upper set 62 is oriented horizontally above and closest to the top inner surface 40 of the inner box 32 followed by the remaining shield elements 72,74,76,78,80,82,84,86 which are each oriented horizontally to form a horizontally stacked, layered configuration above the top inner surface 40 to thus form a shield arrangement that mirrors the lower set 60. The first through sixth shield elements 70,72,74,76,78,80 are located within the opening 58 of the outer box 34 when the layered shield 30 is assembled. The top outer surface 52 of the outer box 34 is positioned between the sixth 80 and seventh 82 shield elements when the layered shield 30 is assembled and serves as an additional shield element. The seventh 82, eighth 84 and ninth 86 elements are fastened to the top outer surface 52.

The right set 64 includes first 90, second 92, third 94, fourth 96, fifth 98, sixth 100, seventh 102, eighth 104 and ninth 106 vertical shield elements. The first shield element 90 is oriented vertically adjacent and closest to the right inner surface 36 of the inner box 32 followed by the remaining shield elements 92,94,96,98,100,102,104,106 which are each oriented vertically to form a vertically stacked, layered configuration to the right of the right inner surface 36. The first 90 and second 92 shield elements each include 30% borated polyethylene. The third 94, fourth 96 and fifth 98 shield elements include lead, 5% borated polyethylene and lead material, respectively, arranged in an alternating configuration. The sixth 100 and seventh 102 shield elements each include 5% borated polyethylene material. The eighth 104 and ninth 106 shield elements each include standard polyethylene material. The first through sixth shield elements 90,92,94,96,98,100 are located within the opening 58 of the outer box 34 when the layered shield 34 is assembled. The right outer surface 48 of the outer box 34 is positioned between the sixth 100 and seventh 102 shield elements when the layered shield 30 is assembled and serves as an additional shield element. The seventh 102, eighth 104 and ninth 106 elements are fastened to the right outer surface 48.

The left set 66 includes a second set of the first through ninth shield elements 90,92,94,96,98,100,102,104,106. The first shield element 90 is oriented vertically adjacent and closest to the left inner surface 38 of the inner box 32 followed by the remaining shield elements 92,94,96,98,100,102,104,106 which are each oriented vertically to form a vertically stacked, layered configuration to the left of the left inner surface 38 to thus form a shield arrangement that minors the right set 64. The first through sixth shield elements 90,92,94,96,98,100 are located within the opening 58 of the outer box 34. The left outer surface 50 of the outer box 34 is positioned between the sixth 100 and seventh 102 shield elements when the layered shield 30 is assembled and serves as an additional shield element. The seventh 102, eighth 104 and ninth 106 elements are fastened to the left outer surface 50.

The rear set 68 includes a third set of the first through ninth shield elements 90,92,94,96,98,100,102,104,106. The first shield element 90 is oriented vertically adjacent and closest to the inner back surface 44 of the inner box 32 followed by the remaining shield elements 92,94,96,98,100,102,104,106 which are each oriented vertically to form a layered configuration to the rear of the inner back surface 44. The first through sixth shield elements 90,92,94,96,98,100 are located within the opening 58 of the outer box 34 when the layered shield 30 is assembled. The outer back surface 56 of the outer box 34 is positioned between the sixth 100 and seventh 102 shield elements when the layered shield 30 is assembled and serves as an additional shield element. The seventh 102, eighth 104 and ninth 106 elements are fastened to the outer back surface 56. In addition, shims 101 are located between the sixth shield element 100 and the outer back surface 56 to provide support to the first through sixth shield elements 90,92,94,96,98,100.

A front edge 108 of each of the first through ninth shield elements 70,72,74,76,78,80,82,84,86 in the lower set 60, the top 40 and bottom 42 inner surfaces and the top 52 and bottom 54 outer surfaces has a curved shape for accommodating the curvature of a cyclotron. In addition, several front edges 108 of the first through ninth shield elements 70,72,74,76,78,80,82,84,86, the bottom 42 inner surface, and the bottom 54 outer surface has a notch 110. The layered shield 30 includes the cover 112 that includes a cover opening 114 for providing access to the recess 46. The cover 112 is curved to correspond to the shape of the front edges 108 in order to also accommodate the curvature of a cyclotron. Further, the cover 112 includes a cutout 116 which corresponds to the notches 110 thus forming a channel 118 when the layered shield 30 is assembled. The cover 112 may be fabricated from aluminum or other suitable material. The channel 118 serves to accommodate and route cables and wires for the cyclotron. Although the lower 60, upper 62, right 64, left 66 and rear 68 sets in the current embodiment are described as having nine shield elements, it is understood that additional or fewer shield elements may be used.

Figure 5:
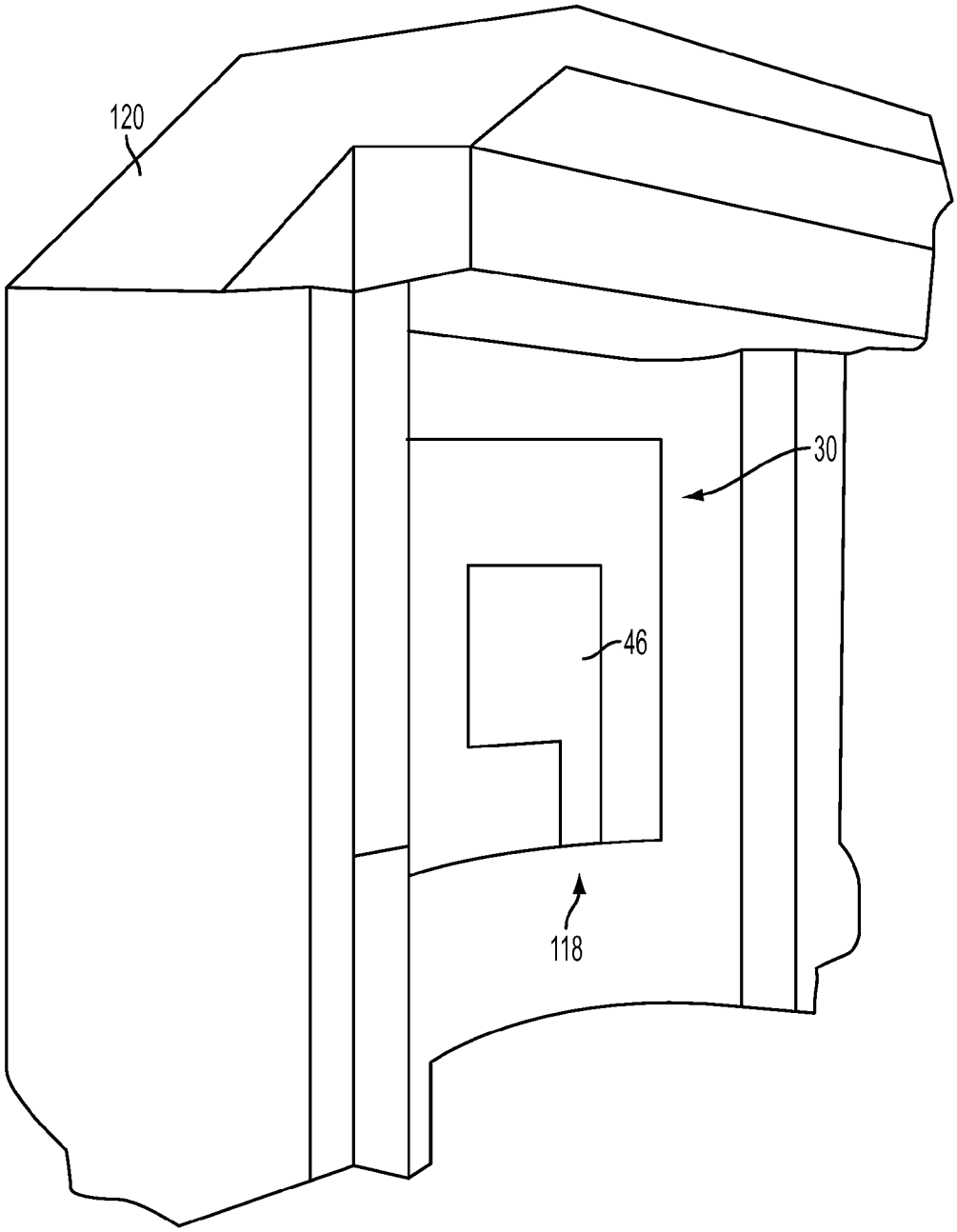
FIG. 5 depicts the layered shield assembled in a movable shield.
Figure 6:
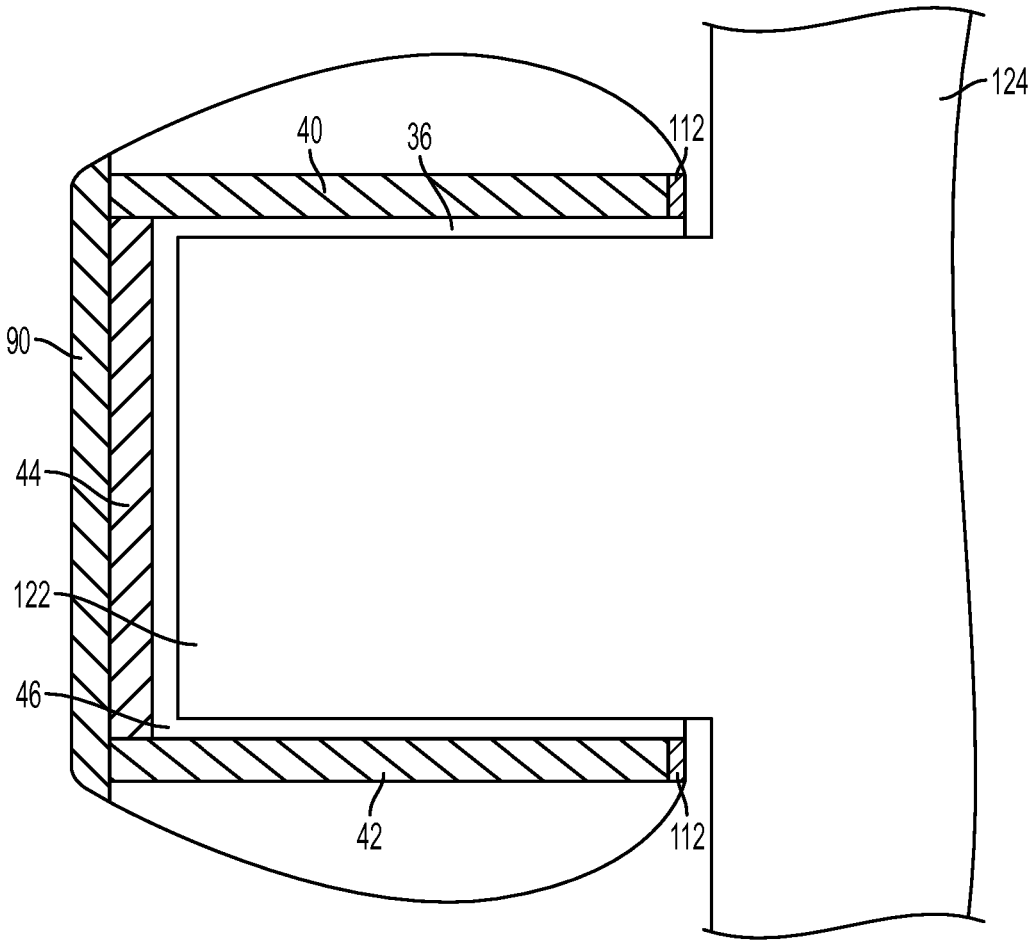
FIG. 6 depicts a target portion of a cyclotron located within a recess of the layered shield assembly.

Referring to FIG. 5, the layered shield 30 is shown assembled in a movable shield 120. The layered shield 30 is located in the movable shield 120 so that the recess 46 receives a target portion of a cyclotron. The layered shield 30 may be assembled in both moveable shields of a cyclotron system. Referring to FIG. 6, a target portion 122 of a cyclotron 124 is shown located within the recess 46 of the layered shield 30. In accordance with the invention, positioning of the target portion 122 within the recess 46 enables the layered shield 30 to provide a primary or substantial portion of the shielding necessary to protect personnel in the vicinity of the cyclotron 124 against unsafe levels of radiation. The configuration described in relation to FIG. 4 is sufficient for shielding against radiation emitted during operation of a cyclotron having an energy level of approximately 11 MeV such as a Siemens Eclipse™ cyclotron.

Each shield element 70,72,74,76,78,80,82,84,86 (i.e. 70-86) and 90,92,94,96,98,100,102,104,106 (i.e. 90-106) of the lower 60, upper 62, right 64, left 66 and rear 68 sets serves as a shield layer. Due the horizontal and vertical stacking arrangement, each shield element 70-86 and 90-106 may be removed and replaced with another shield element 70-86 or 90-106 or with other shield elements having alternative shielding materials or alternative shielding characteristics. The removability of the shield elements 70-86 and 90-106 enables upgrading or reconfiguring of the layered shield 30 so as to provide sufficient shielding appropriate for cyclotrons having higher or lower radiation energies. In addition, a size of the shield elements 70-86 and 90-106 may be changed to accommodate different size inner 32 and outer 34 box structures that may be used when reconfiguring the layered shield 30. This allows arrangements that are specifically designed for the radiation emitted from specific cyclotron configurations. In addition, providing interchangeable shielding elements 70-86 and 90-106 enables minimization of the amount of lead that is used thus minimizing the environmental impact of the shielding. Further, the order of the shield elements 70-86 and 90-106 may be rearranged as desired.

The removability of the shielding elements 70-86 and 90-106 also enables dismantling of the assembly and stacking is smaller spaces. Conventional shielding is bulky and requires demolition to process the shielding to a state that is disposable. The layered shield 30 may be disassembled and only the portions that are susceptible to radiation are required to be disposed. In an alternate embodiment, a frame having slots may be used to hold the shield elements 70-86 and 90-106 wherein the shield elements 70-86 and 90-106 are slid into and out of a corresponding slot.

While the invention has been described in conjunction with specific embodiments, it is evident that many alternatives, modifications, permutations and variations will become apparent to those skilled in the art in light of the foregoing description. Accordingly, it is intended that the present invention embrace all such alternatives, modifications and variations.

What is claimed is:

1. A shield for absorbing radiation emitted by a target during operation of a cyclotron, wherein the target is located within a target enclosure, comprising:

an inner box structure having a recess for receiving the target enclosure;

a first plurality of shield elements arranged in a layered configuration about the inner box structure to form a first shielding arrangement having first shielding characteristics;

an outer box structure for receiving the inner box structure and the first plurality of shield elements; and a second plurality of shield elements arranged in a layered configuration about the outer box structure to form a second shielding arrangement having second shielding characteristics.

2. The shield according to claim 1, wherein the first and second plurality of shield elements includes at least one shield element fabricated from 30% borated polyethylene.

3. The shield according to claim 1, wherein the first and second plurality of shield elements includes at least one shield element fabricated from 5% borated polyethylene.

4. The shield according to claim 1, wherein the first and second plurality of shield elements includes at least one shield element fabricated from lead.

5. The shield according to claim 1, wherein the first and second plurality of shield elements includes at least one shield element fabricated from polyethylene.

6. The shield according to claim 1, wherein the first and second plurality of shield elements are removable.

7. The shield according to claim 1, wherein the inner and outer box structures are fabricated from steel.

8. The shield according to claim 1, further including a cover fabricated from aluminum.

9. The shield according to claim 1, wherein the shield shields against neutron and gamma radiation.

10. A shield for absorbing radiation emitted by a target during operation of a cyclotron, wherein the target is located within a target enclosure, comprising:

an inner box structure having a recess for receiving the target enclosure;

a first plurality of shield elements arranged in first and second orientations about the inner box structure to form a first shielding arrangement having first shielding characteristics;

an outer box structure for receiving the inner box structure and the first plurality of shield elements; and a second plurality of shield elements arranged in the first and second orientations about the outer box structure to form a second shielding arrangement having second shielding characteristics.

11. The shield according to claim 10, wherein the first orientation is horizontal and the first and second plurality of shield elements are arranged above and below the inner and outer box structures.

12. The shield according to claim 10, wherein the second orientation is vertical and the first and second plurality of shield elements are arranged on sides and to the rear of the inner and outer box structures.

13. The shield according to claim 10, wherein the first and second plurality of shield elements includes at least one shield element fabricated from 30% borated polyethylene.

14. The shield according to claim 10, wherein the first and second plurality of shield elements includes at least one .shield element fabricated from 5% borated polyethylene.

15. The shield according to claim 10, wherein the first and second plurality of shield elements includes at least one shield element fabricated from lead.

16. The shield according to claim 10, wherein the first and second plurality of shield elements includes at least one shield element fabricated from polyethylene.

17. The shield according to claim 10, wherein the first and second plurality of shield elements are removable.

18. A shield arrangement for absorbing radiation emitted by a target during operation of a cyclotron, wherein the target is located within a target enclosure, comprising:

an inner box structure having a recess for receiving the target enclosure;

a first plurality of removable shield elements arranged about the inner box structure to form a first shielding arrangement having first shielding characteristics;

an outer box structure for receiving the inner box structure and the first plurality of shield elements;

a second plurality of removable shield elements arranged about the outer box structure to form a second shielding arrangement having second shielding characteristics wherein the inner and outer box structures and first and second plurality of shield elements form a layered shield assembly; and a movable shield for receiving the layered shield assembly.

19. The shield according to claim 18, wherein the first and second plurality of shield elements are removable.

20. The shield according to claim 18, wherein the shield shields against neutron and gamma radiation.

21. A shield arrangement for absorbing radiation emitted by a target during operation of a cyclotron, wherein the target is located within a target enclosure, comprising:

an inner box structure having a first size and a recess for receiving the target enclosure;

a first plurality of first shield elements arranged about the inner box structure wherein the first shield elements are reconfigurable to provide additional or less shielding or to accommodate an alternate size inner box structure wherein the first shield elements form a first shielding arrangement having first shielding characteristics;

an outer box structure having a second size for receiving the inner box structure and the first plurality of shield elements;

a second plurality of second shield elements arranged about the outer box structure wherein the second shield elements are reconfigurable to provide additional or less shielding or to accommodate an alternate size outer box structure wherein the second shield elements form a second shielding arrangement having second shielding characteristics and wherein the inner and outer box structures and first and second plurality of shield elements form a layered shield assembly; and a movable shield for receiving the layered shield assembly.

* * * * *